United States Patent [19]

Linscheid

[11] Patent Number: 4,578,088

[45] Date of Patent: Mar. 25, 1986

[54] ELECTRICAL INSULATING AND SEALING APPARATUS AND PROCESS FOR USING SAME

[75] Inventor: Denver D. Linscheid, American Falls, Id.

[73] Assignee: FMC Corporation, Philadelphia, Pa.

[21] Appl. No.: 682,624

[22] Filed: Dec. 17, 1984

[51] Int. Cl.[4] ..... B03C 3/00

[52] U.S. Cl. ..... 55/2; 55/146; 174/18; 174/142

[58] Field of Search ..... 55/146, 2; 174/18, 142

[56] References Cited

U.S. PATENT DOCUMENTS

| | | | |
|---|---|---|---|
| 1,491,274 | 4/1924 | Rathbun | 174/14 BH |
| 1,841,071 | 1/1932 | Waggamen et al. | 423/323 |
| 1,994,259 | 3/1935 | Thorne | 173/318 |
| 2,944,325 | 7/1960 | Clark | 29/155.55 |
| 3,094,585 | 6/1963 | Rudner | 174/77 |
| 3,118,734 | 1/1964 | Miles et al. | 423/323 |
| 3,301,938 | 1/1967 | Frey | 174/31 |
| 3,595,983 | 7/1971 | Muller et al. | 174/31.5 |
| 3,627,898 | 12/1971 | Ibach et al. | 174/11 BH |
| 3,755,611 | 8/1973 | Queck et al. | 174/31 R |
| 3,773,966 | 11/1973 | Ebert et al. | 174/31.5 |
| 4,117,255 | 9/1978 | Kawaike et al. | 55/146 |

FOREIGN PATENT DOCUMENTS

| | | | |
|---|---|---|---|
| 660713 | 5/1979 | U.S.S.R. | 55/146 |

*Primary Examiner*—Bernard Nozick

*Attorney, Agent, or Firm*—Frank Ianno; Eugene G. Seems

[57] ABSTRACT

An electrical insulating and sealing apparatus, and process of using same, is described for use in an electrostatic precipitator. The apparatus employs a flexible insulator seal through which passes an electrical lead-in conductor with rubber boots to seal the insulator seal against gas leakage. Also provided are a manifold and venturi section surrounding the insulator seal to permit a pressurized gas to impinge on the insulator seal and flow downwardly over the seal through the venturi section at increased speed to help clean and keep clean the surface of the insulator seal.

8 Claims, 1 Drawing Figure

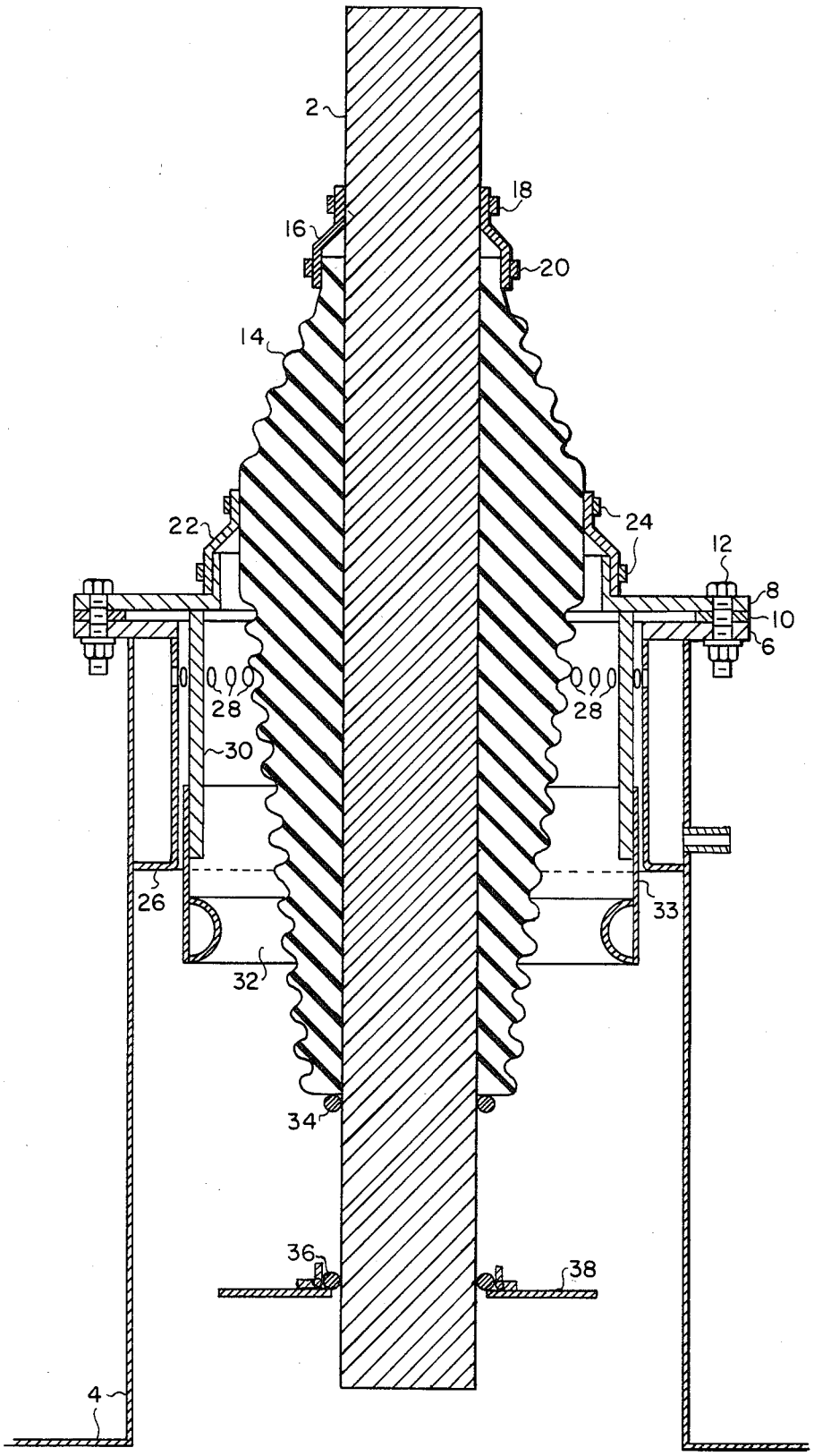
2
18
16
20
14
22
24
12
8
10
6
28
28
30
26
33
32
34
36
38
4

ELECTRICAL INSULATING AND SEALING APPARATUS AND PROCESS FOR USING SAME

The present invention relates to an electrical insulating and sealing apparatus, and to the process of using same, in an electrical conducting device, such as an electrostatic precipitator. It has specific application in the process of producing elemental phosphorus wherein calcined phosphate agglomerates, carbon and silica are used as feed to an electrical furnace to reduce the phosphate ore into elemental phosphorus.

In conventional, known furnace operations wherein an ore is fed to an electric furnace and treated at high temperatures to recover a mineral product, such as in the production of elemental phosphorus, the separation and collection of particles and gases in a safe manner poses serious obstacles. In the operation of electrical furnaces, such as those employed in producing phosphorus, the ore is mixed with carbon and silica and this mixture (termed "burden") is contained in feed bins located above the furnace and is fed to the furnace, on demand, through feed chutes connecting the feed bins with the furnace. In order to prepare the phosphate ore for use in the furnace, the ore is crushed, agglomerated by briquetting, pelletizing, or sintering into compacted shapes, and the shapes are calcined to remove combustible and other gas producing elements from the ore. This procedure for preparing phosphate ore into briquettes suitable for use in a phosphorus furnace is described in U.S. Pat. No. 3,760,048 issued on Sept. 18, 1973 in the names of James K. Sullivan et al.

In the furnace, the phosphate feed is converted to elemental phosphorus vapor and is discharged overhead from the furnace along with other gases, principally carbon monoxide. In addition to these gases, dust is also discharged overhead. The dust arises from breakdown of some agglomerates and carbon particles in the furnace. The conventional manner of separating the dust from the gases, prior to condensing the phosphorus vapor from the remaining noncondensable gases, is to treat the mixture in an electrostatic precipitator.

The construction of the electrostatic precipitator must be adopted to allow the dust and phosphorus-containing gas mixture to pass through the precipitator without allowing any air, or other combustible gases, to contact the phosphorus, since phosphorus will burn on contact with air. Additionally, electrical rods must be provided to carry the electrical charge into the precipitator, but the annular space between the rods and precipitator frame must be sealed to prevent phosphorus gases from escaping. The seals must also provide sufficient electrical insulation to prevent leakage of electric current from the rods to the frame of the precipitator, and must be resistant to the high temperatures (over 300° C.) of the phosphorus-containing vapors that contact them.

In previous practice such precipitator seals were effected by utilizing a relatively nonvolatile, noncombustible oil. The oil confined the phosphorus vapor inside the precipitator out of contact with the atmosphere, and was a sufficiently good electrical insulator to prevent leakage of electrical current.

Although extensively used, the oil seals had serious drawbacks. Among the most serious is that the oil required constant replacement at given intervals as its phosphorus content increased. The job of removal and replacement of such hot oil and disposal of the phosphorus-containing oil is formidable. Also, if the pressure in the precipitator surges sufficiently, generally due to pressure shifts in the furnace, the hot oil can be blown out of its seal and onto adjacent equipment in the plant. The precipitator then becomes inoperable and must be removed from use. To put the precipitator back on line, additional oil must be added to seal the unit from the atmosphere, and the spilled phosphorus-containing oil which has been blown onto the top of the precipitator unit and any other plant equipment in the vicinity, must be mopped up and disposed of.

The use of solid precipitator seals have also been attempted, using temperature resistant substances that do not deteriorate at the high temperatures the phosphorus vapor is maintained. However, these have not been found successful because phosphorus builds up on the underside of the seal causing them to arc. Also, they have not been found durable because the electrical rods constantly shift in position compared with the precipitator frame. The sealing material between the rods and frame is worn down quickly by such movement and eventually fails, thereby creating an unacceptable gap in the seal around the electrical rod through which phosphorus vapor inside the precipitator can contact the outside atmosphere.

It has now been found that the above deficiencies in prior art systems can be overcome by the present apparatus and the processing of using same. The apparatus is durable, does not require periodic replacement due to wear from rod movement, and the process of using same substantially eliminates the prior art problem of arcing. The apparatus and the process of using same will be described by reference to the attached drawing.

BRIEF DESCRIPTION OF THE DRAWING

In the drawing, there is illustrated a sectional view of an electrical rod and the sealing apparatus of the instant invention; the flexible sealing member 14 seals the annulus around the electrical rod 2 adjacent the frame of the precipitator 4 so that both an electrical seal and a vapor tight seal are formed.

A detailed description of the invention set forth in the drawing, and its method of operation, follow:

In the drawing, the upper wall of the electrostatic precipitator 4 terminates in a flange 6 having a circular opening therein, through which the electrical rod 2 enters the electrostatic precipitator. An adaptor flange 8 and gasket 10 sit on top of flange 6. The entire dry seal compartment assembly consisting of adaptor flange 8, gasket 10 and flange 6 are bolted together using a plurality of hex bolts 12 which are placed in a circular pattern around both flanges. The dry seal and insulator component 14 is preferably made up of a flexible and heat resistant insulating material, preferably (Teflon) tetrafluoroethylene polymer. The Teflon material has a hole drilled through it so that when the dry seal 14 is inserted over electrical rod 2 it forms a tight, close fit between the Teflon and the electrical rod 2. The Teflon material also acts as an electrical insulator so that there is no electrical leakage from the electrical rod 2 to any metal hardware surrounding the electrical rod 2, and specifically flange 6 or adaptor flange 8 and any metal connections thereto. The upper portion of dry seal 14 is held in vapor tight contact with electrical rod 2 by means of seal boot 16, which is preferably made of a flexible rubber such as Viton, and the top of boot 16 is held tightly to electrical rod 2 by means of circular clamp 18.

A second clamp 20 holds the bottom of boot 16 tightly to the top of the teflon dry seal 14.

A second flexible seal boot 22, made of the same rubber material as seal boot 16, seals the middle section of the dry seal 14 against the top of the adaptor flange 8 by means of clamps 24. It is important that the seal boots 16 and 22 be made of a rubber-like material that is sufficiently flexible to allow lateral movement of the electrical rod 2 relative to the fixed electrical precipitator 4 and its dry seal compartment assembly made up of flanges 6, 8 and gasket 10.

Attached to the inside wall of the electrostatic precipitator is a manifold assembly 26 fashioned like a hollow doughnut to the wall of the electrostatic precipitator. The inside wall of manifold 26 has a plurality of holes 28 along the top circumference thereof which communicates through the wall of the manifold so that any gases within the manifold can flow through the holes 28.

Adaptor flange 8 has appended from it downward positioned support tabs 30 whose lower ends hold a cylinder shaped member 33. A doughnut member 32 is positioned at the lower inside lip of cylinder 33 which decreases the internal diameter of the cylinder shaped member 33 so as to form a venturi.

At the base of the dry seal 14, is a support ring 34 which keeps the dry seal 14 in a fixed position relative to electrical rod 2, and prevents the dry seal 14 from moving downwardly along the shaft of electrical rod 2. Further down electrical rod 2 is a second ring 36 which holds flop gates 38. Flop gates 38, when opened, extend radially from sealing rod 2, and thereby expand into and cover a substantial portion of the area bounded by the vertical cylindrical walls 4 of the electrostatic precipitator. The function of flop gates 38 is to act as a barrier to the flow of phosphorus vapors from inside the electrostatic precipitator upward into the seal assembly.

In operation, the electrical rod 2 is connected to a source of electrical current (not shown) at its upward end and carries the current to elements (not shown) within the electrostatic precipitator at its lower end. Phosphorus vapors from the electrostatic precipitator are confined within the cylindrical walls 4, by the dry seal compartment assembly made up of flanges 6, 8 and gasket 10, and also the dry seal 14, which with seal boots 22 and 16 form a barrier to the escape of phosphorus vapor from inside the electrostatic precipitator. Lateral movement of the electrical rod 2 within the flange assembly does not affect the seal, nor does it wear down the dry sealing member 14 because the flexible seal boots 16 and 22 hold the Teflon dry seal 14 against the upper flange 8 and the electrical rod 2 without any wear on the dry seal member 14 whatsoever.

In practice, if the exposed portion of the Teflon dry seal 14 becomes dirtied by phosphorus or other particulates adhering onto its surface, it becomes conductive and will arc. To prevent this, steam or other inert gas at a temperature above the condensing point of phosphorus is introduced under pressure into manifold 26. The gas escapes through the numerous holes 28 located along the upper circumference of the manifold 26 and impinge on the surface of the dry seal 14. The continuous impingement of the inert gas on the surface of Teflon dry seal 14 reduces the tendency of phosphorus or other particulates to remain on the surface of the dry seal 14. The inert gas after it has come through holes 28 and has impinged on the dry seal 14 is directed downwardly along the surface of the dry seal 14 and manifold 26 until it passes through cylinder 33 and comes to the venturi section 32 at the lip, where the downward velocity of the gas is increased. The increased velocity of the steam or other inert gas flowing downwardly over the surface of the Teflon dry seal 14 drives phosphorus and other particles away from the surface of the dry seal 14 and further impedes the ability of other particulates to flow upwardly towards the seal. In effect, the gas flowing under high velocity downwardly in the space formed by the vertically oriented, cylindrical walls 4 forms a continuous wall of gas that acts as a barrier to the upward flow of phosphorus and particulates towards the seal. To further impede the progress of phosphorus and other particles upwardly toward the seal, flop gates 38 when in their open position extend radially and horizontally over a portion of the cylindrical area, and further block the upward path of phosphorus and other such materials.

Pursuant to the requirements of the patent statutes, the principle of this invention has been explained and exemplified in a manner so that it can be readily practiced by those skilled in the art, such exemplification including what is considered to represent the best embodiment of the invention. However, it should be clearly understood that, within the scope of the appended claims, the invention may be practiced by those skilled in the art, and having the benefit of this disclosure, otherwise than as specifically described and exemplified herein.

What is claimed is:

1. A process of keeping an electrical insulator seal clean of deposits and particulates, wherein said insulator seal seals a lead-in conductor passing through it and through the wall of an electrical precipitating apparatus comprising passing a pressurized gas into a manifold extending concentrically around the lower portion of said insulator seal, removing the gas through a plurality of holes in the manifold adjacent the insulator seal, allowing the removed gas to impinge on the surface of the insulator seal, passing the impinged gas downwardly through a cylindrical member having a lower lip of decreased internal diameter extending concentrically around the lower portion of said insulator seal, said lip creating a venturi section at the base of said cylindrical member, said gas increasing in velocity as it flows downwardly through the venturi and over the surface of said insulator seal, thereby hindering deposition of particulates and condensables on the surface of said insulator seal.

2. The process of claim 1 wherein said electrical precipitator apparatus is used to precipitate dust from phosphorus vapor during the manufacture of phosphorus, said insulator seal seals phosphorus vapor within said apparatus, and said gases are maintained at a sufficiently high temperature to stop condensation from any phosphorus vapor contacting said insulator seal.

3. The process of claim 2 wherein said gas is steam.

4. An electrical insulating and sealing assembly comprising a lead-in conductor which passes through the wall of an electrical precipitation apparatus and down to its electrode system, wherein a middle portion of the conductor is concentrically surrounded by a dry seal assembly, said assembly including an upper adaptor flange sealed to a lower flange connected to said wall, a flexible insulator seal through which the conductor passes extending both above and below said dry seal assembly, a first flexible seal boot extending concentrically about the insulator seal, the upper portion of the boot being affixed to the insulator seal and the lower portion of the boot being affixed to said adaptor flange to form a gas tight seal between the insulator seal and the adaptor flange, a second flexible seal boot extending concentrically about said insulator seal, the upper portion of the boot being affixed to said conductor and the lower portion of the boot being affixed to the insulator seal to form a gas tight seal between the insulator seal and the conductor, a manifold extending concentrically around said insulator seal, a plurality of holes in said manifold adjacent the insulator seal for permitting pressurized gas to escape from said manifold and impinge on and keep clean the surface of said insulator seal, a cylindrical member having a lower lip of decreased internal diameter extending concentrically around the lower portion of said insulator seal, which lip creates a venturi section at the base of said cylindrical member, whereby gases from said manifold and holes that impinge on said insulator seal are led downwardly at increased speed through the venturi section of said cylindrical member to keep clean the lower portion of said insulator seal.

5. The apparatus of claim 4 wherein the lead-in conductor and electrode system are used to electrically precipitate dust from phosphorus vapor during the manufacture of phosphorus.

6. The apparatus of claim 4 wherein said insulator seal is made of Teflon.

7. The apparatus of claim 4 wherein said seal boots are made of a flexible rubber.

8. The apparatus of claim 4 wherein gates which extend radially and horizontally are placed below the insulator seal to impede any upward flow of phosphorus vapors and particulates towards the insulator seal.

* * * * *